US006793510B2

(12) United States Patent
Yamakawa et al.

(10) Patent No.: US 6,793,510 B2
(45) Date of Patent: Sep. 21, 2004

(54) PROTECTING DEVICE AND METHOD OF SHUTTING OFF A POWER SUPPLY

(75) Inventors: Shuji Yamakawa, Yokkaichi (JP); Eriko Yuasa, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/290,439

(22) Filed: Nov. 7, 2002

(65) Prior Publication Data

US 2003/0087542 A1 May 8, 2003

(30) Foreign Application Priority Data

Nov. 7, 2001 (JP) ..... 2001-341739

(51) Int. Cl.[7] ..... H01R 29/00
(52) U.S. Cl. ..... 439/188; 439/189

(58) Field of Search ..... 439/188, 189, 439/108

(56) References Cited

U.S. PATENT DOCUMENTS 4,469,128 A * 9/1984 Petrimaux et al. ..... 137/554
4,814,941 A * 3/1989 Speet et al. ..... 361/622
2002/0182913 A1 * 12/2002 Yamakawa et al. ..... 439/188

* cited by examiner

*Primary Examiner*—Chandrika Prasad
(74) *Attorney, Agent, or Firm*—Gerald E. Hespos; Anthony J. Casella

(57) ABSTRACT

A protecting device is constructed by detachably mounting a protection plug in a fixed member and connecting a movable circuit in the protection plug and a fixed circuit in the fixed member to supply a power to a load and designed to prevent an arc from being created between input and output terminals when the protection plug is detached to shut a power supply off.

20 Claims, 6 Drawing Sheets

PROTECTING DEVICE AND METHOD OF SHUTTING OFF A POWER SUPPLY

BACKGROUND OF THE INVENTION

1. Field of the Invention

The invention relates to a protecting device and to a method for shutting off a power supply, and is designed to protect terminals by preventing arcs from being created between the terminals electrically disconnected when a power supply circuit in a relay block connected with a battery in an automotive vehicle is broken for maintenance or the like.

2. Description of the Related Art

The power supply from a battery should be shut off before conducting maintenance on various types of electrical equipment in an automotive vehicle, such as maintenance on a navigation system or a radio.

Batteries installed in a conventional passenger vehicle typically have been rated 12V or at maximum 14V. However, the number of electrical devices installed in automotive vehicles has increased recently and the amount of current supplied to each electrical device also has increased in recent years. Accordingly, high-voltage batteries of 36V to 200V have been proposed.

Safety considerations mandate shutting off the power supply from a high-voltage battery before conducting maintenance of electrical equipment with a power supply from a high-voltage battery.

In view of the above, a protecting device has been developed. The protecting device has a fixed member with a power supply connected circuit and a load-connected circuit. A protection plug is mounted detachably in the fixed member and has a power supply switching circuit for connecting the power supply connected circuit and the load-connected circuit. The fixed member may be accommodated in a relay block connected with a battery.

The power supply connected circuit and the load-connected circuit of the above-described protecting device are connected electrically by connecting a terminal of the circuit in the protection plug and a terminal of a circuit in an electrical connection box. The protection plug is detached from the fixed member to disconnect the terminals from each other for maintenance.

However, the use of a high-voltage battery creates the likelihood for an arc between the terminals when the protection plug is detached from the fixed member to disconnect the terminals. The arc can damage the terminals.

The invention was developed in view of the above problem and an object thereof is to prevent the creation of an arc between terminals when a protection plug is detached from a fixed member at the time of maintenance.

SUMMARY OF THE INVENTION

The invention is directed to a protecting device in which a protection plug or member for switching a power supply circuit is mounted detachably to a fixed member to connect a movable circuit in the protection plug and a fixed circuit of the fixed member and to form a power supply circuit for supplying a power to a load. The power supply circuit is broken by detaching the protection plug. An input contact portion, a temporal circuit contact portion and an output circuit portion are provided between a terminal in the movable circuit of the protection plug and a terminal in the fixed circuit of the fixed member. The input contact portion and the output contact portion are closed or electrically turned on to supply power to the load and the temporal circuit contact portion is opened or electrically turned off in a normal state where the protection plug is mounted to the fixed member. The temporal circuit contact portion is closed or electrically turned on and connected with the power supply circuit with the input and output contact portions closed or electrically turned on at a first stage during the detachment of the protection plug. Either one of the input and output contact portions is opened or electrically turned off at a second stage. The temporal circuit contact portion is opened or electrically turned off at a third stage, and the other of the input and output contacts is opened or electrically turned off at a fourth stage.

The temporal circuit contact portion is off in the normal state where the protection plug is mounted to the fixed member of the above-described protecting device to prevent the creation of an arc when the power supply circuit is broken. The temporal circuit contact portion is temporarily turned on when the power supply circuit is broken by detaching or manipulating the protection plug. Thus, no arc is created between the terminals when the input and output contacts of the power supply circuit are separated.

Specifically, the temporal circuit contact is closed (or electrically turned on) with both input and output contacts closed, thereby connecting with a power supply side circuit and/or a load side circuit of the fixed circuit via the temporal circuit. The power supply and the load are connected via the temporal circuit when the input contact of the power supply side circuit or the output contact of the load side circuit connected with the temporal circuit is opened (turned off) at the second stage. This can prevent an arc from being created between the terminals to be disconnected.

The temporal circuit contact is opened or electrically turned off after the input contact or the output contact is turned off. At this time, there is a possibility of creating an arc between the fixed terminal for temporal circuit of the fixed member and the movable terminal for temporal circuit of the protection plug forming the temporal circuit contact portion since these two terminals are disconnected in an electrically conductive state. However, the temporal circuit contact preferably is made of an arc resistant material. Thus, the terminals at the temporal circuit contact portion are unlikely to be damaged even if an arc is created. Even if they should be damaged, it does not present a big problem as compared to a case where the terminals at the output and input contact portions are damaged as these terminals are not intended for power conduction in a normal state.

One of the input and output contact portions is opened or electrically turned off to separate the terminals after the temporal circuit contact portion is turned off. At this time, the temporal circuit contact portion is already off and the other of the input and output contact portions is already off and, hence, the fixed circuit and the movable circuit are electrically disconnected, i.e. no current flows between these two circuits. Therefore, there is no danger of creating an arc between the terminals being disconnected to damage the terminals.

The terminals at the input and output contact portions, which are closed (or electrically turned on) in the normal state to form the power supply circuit, are not damaged. Thus, the electrical connection reliability of the power supply circuit can be improved.

One and the other of a movable terminal for temporal circuit of the protection plug and a fixed terminal for temporal circuit of the fixed member forming the temporal circuit contact portion may have a first contact comprising a long protuberance that is long substantially along a detachment direction of the protection plug and a second contact comprising a small protuberance.

Preferably, the first and second contacts are separated or electrically turned off in the normal state where the protection plug is mounted to the fixed member and are brought into sliding contact with each other during the detachment of the protection plug to enable a control of on-off periods.

One and the other of a movable terminal for temporal circuit of the protection plug and a fixed terminal for temporal circuit of the fixed member forming the temporal circuit contact portion preferably have a first contact made of a vertically long protuberance and a second contact made of a small protuberance. The first and second contacts are separated or electrically turned off in the normal state where the protection plug is mounted in the fixed member and are brought into sliding contact with each other during the detachment of the protection plug, thereby enabling a control of on-off periods.

A fixed terminal for temporal circuit of the fixed member forming the temporal circuit contact portion may comprise a spring piece biased in a direction to contact a movable terminal for temporal circuit of the protection plug and a second contact projects from the spring piece.

A movable terminal for temporal circuit of the temporal circuit contact portion in the protection plug may comprise a tab projecting towards the fixed member from a casing of the protection plug. A first contact may project from the tab and an insulating guide piece may project from the casing at the side of the tab.

The first and second contacts preferably are spaced apart although the insulating guide piece biases the spring piece toward the movable terminal for temporal circuit in the normal state where the protection plug is mounted to the fixed member. The first contact of the movable terminal for temporal circuit preferably is moved into contact with the second contact and the fixed terminal for temporal circuit is returned substantially to its original shape by its spring force when the insulating guide piece is disengaged therefrom to separate the first and second contacts at the first stage during the detachment of the protection plug.

A fixed terminal for temporal circuit of the fixed member forming the temporal circuit contact portion preferably is formed of a spring piece biased for contact with a movable terminal for temporal circuit of the protection plug and a second contact projects from the spring piece. However, a movable terminal for temporal circuit of the temporal circuit contact portion in the protection plug is formed of a tab that projects down from a casing of the protection plug, a first contact projects from the tab and an insulating guide piece projects from the casing at the side of the tab. The first and second contacts are spaced apart, but the insulating guide piece biases the spring piece toward the movable terminal for temporal circuit in the normal state where the protection plug is inserted in the fixed member, the first contact of the movable terminal for temporal circuit is moved for contacting the second contact and the fixed terminal for temporal circuit is returned to its original shape by its spring force when the insulating guide piece is disengaged to separate the first and second contacts at the first stage during the detachment of the protection plug.

The on-off periods of the temporal circuit contact portion may be controlled by adjusting the length of the slidable first contact or by the combination of the spring piece and the insulating guide piece.

Specifically, the fixed terminal for temporal circuit of the temporal circuit contact portion is formed of a spring piece biased in a direction to open the contact portion and the second contact in the form of a small protuberance projects from the spring piece. However, the movable terminal for temporal circuit of the protection plug is formed of a tab projecting down from the casing of the protection plug, and the vertically long first contact projects from the tab and the insulating guide piece projects out of the casing at the side of the tab.

In the normal state where the protection plug is inserted, the insulating guide piece biases the fixed terminal for temporal circuit in a direction to bring it into contact with the movable terminal for temporal circuit of the protection plug against the spring force, but the second contact is spaced up from the first contact. Thus, the temporal circuit contact portion is open.

The movable terminal for temporal circuit is moved up to bring the first contact into contact with the second contact to thereby close the temporal circuit contact portion at the first stage during the detachment of the protection plug, and the insulating guide piece is disengaged from the fixed terminal for temporal circuit at the third stage, thereby returning this terminal to its original position to open the temporal circuit contact portion.

There is a possibility of creating an arc when the terminals at the temporal circuit contact portion are disconnected, these terminals are made of a more arc resistant material than of the input and output contact portions, such as a Ag—Cdo material, a Ag—Ni material, a Ag-metallic oxide material and an Ag-Gr material, so as not to be damaged even if an arc is created.

Preferably, the movable terminal for temporal circuit and/or the fixed terminal for temporal circuit are made of an arc resistant material.

Tabs that will form the input and output contact portions preferably project toward the protection plug or up in the fixed circuit of the fixed member. The tab of the input contact portion projects a longer distance than that of the output contact portion. Recesses are formed in the mating side surfaces or bottom end surfaces of projecting portions or downward-projecting portions at the opposite sides of a casing of the protection plug, and female terminals connectable with the corresponding tabs are mounted in these recesses. The tabs and the female terminals at the input and output contact portions preferably are still connected with each other at the first stage during the detachment of the protection plug. The female terminal of the output contact portion is separated from the corresponding tab at the second stage, and the female terminal of the input contact portion is separated from the corresponding tab to open the input contact portion at the fourth stage after the temporal circuit contact portion is opened or electrically turned off.

The downward-projecting portions are provided at the opposite sides of the casing of the protection plug, the bottom end surfaces of the downward-projecting portions are located at the same height, and the recesses are formed in these bottom end surfaces. The depths of the recesses are preferably made larger at the input terminal side than at the output terminal side, the output contact portion and the input contact portion are closed (or electrically turned on) in the normal state where the protection plug is mounted in the fixed member, and the output contact portion is turned off earlier than the input contact portion when the protection plug is pulled upward.

An electrically conductive plate having the opposite ends connected with the input terminal and the output terminal is built in the casing of the protection plug, and the terminal (movable terminal for temporal circuit) of the temporal circuit contact portion formed by a tab branched off from the electrically conductive plate projects downward from the inside of the casing.

The insulating guide piece is so caused to project downward as to face this tab, and the temporal circuit contact portion is opened (or electrically turned off) by the disengagement of the insulating guide piece from the spring piece before the input contact portion is opened (or electrically turned off).

A ground circuit preferably is branched off from the temporal circuit contact portion between the terminal of the temporal circuit contact portion and the output contact portion in the fixed circuit of the fixed member.

A ground circuit is branched off between the terminal of the temporal circuit contact portion and the tab of the output contact portion in the fixed circuit of the fixed member. The ground circuit is provided with a ground circuit contact portion where a spring piece is brought resiliently into contact with a tab, and an insulating bar projects from the protection plug. The insulating bar is inserted between the spring piece and the tab to open the ground circuit contact portion in the normal state where the protection plug is inserted in the fixed member, and the insulating bar is disengaged from the ground circuit contact portion to close the ground circuit contact portion and connect the load with the ground circuit after the input contact portion is opened (or electrically turned off) at the fourth stage during the detachment of the protection plug.

The ground circuit preferably is branched off between the terminal of the temporal circuit contact portion and the tab of the output contact portion in the fixed circuit of the fixed member.

The ground circuit preferably is provided with a ground circuit contact portion where a spring piece is brought resiliently into contact with a tab.

An insulating bar preferably projects from the protection plug, and the insulating bar can open the ground circuit contact portion in the normal state where the protection plug is mounted to the fixed member by being insertable between the spring piece and the tab. The insulating bar can close the ground circuit contact portion and allow a connection of the load with the ground circuit by being disengageable from the ground circuit contact portion, after the input contact portion is opened at the fourth stage during the detachment of the protection plug.

The insulating bar of the protection plug for opening and closing the ground circuit contact portion is formed integrally or unitarily at the middle recess of the casing of the protection plug and projects down toward the fixed member. The insulating bar projects farther than the downward projecting portions at the opposite ends, so that the insulating bar is disengaged from the terminals at the final stage where the input contact portion is opened (or electrically turned off), thereby closing the ground circuit contact portion. In this way, the load-side circuit shut off from the battery is connected with the ground circuit to ground the electrical charges residual in the load-side circuit.

Preferably, the fixed member is mounted in an accommodating portion formed in a relay block, and an upstream end of the fixed circuit of the fixed member is connected with a high-voltage battery of 36V to 200V.

As described above, when the high-voltage battery is used, the safety of the maintenance can be improved if the protection plug is provided in the relay block at a position near the battery to shut off the power supply at the time of maintenance. Further, since an arc is likely to be created between the terminals being disconnected at the time of shutting off the power supply if the high-voltage battery is used, the damage of the terminals due to the arc created between the terminals being disconnected at the input contact portion can be prevented if the temporal circuit contact portion is provided in the protection plug and the power supply is shut off by stepwise opening the contact portions from the output contact portion to the temporal circuit contact portion and to the input contact portion.

The invention relates to a method of shutting off a power supply by means of a protecting device in which a protection plug for switching a power supply circuit is detachably mountable to a fixed member to connect a movable circuit in the protection plug and a fixed circuit of the fixed member and form a power supply circuit for supplying power from the power supply to a load. The power supply circuit is broken by detaching the protection plug. The method comprises providing an input contact portion, a temporal circuit contact portion and an output circuit portion between a terminal in the movable circuit of the protection plug and a terminal in the fixed circuit of the fixed member. The method then comprises closing or electrically turning on the input contact portion and the output contact portion to supply power to the load and opening (electrically turning off) the temporal circuit contact portion in a normal state where the protection plug is mounted to the fixed member. The method further comprises closing or electrically turning on the temporal circuit contact portion and connecting it with the power supply circuit with the input and output contact portions closed at a first stage during the detachment of the protection plug. The method continues by opening (electrically turning off) either one of the input and output contact portions at a second stage. The method then includes opening (electrically turning off) the temporal circuit contact portion at a third stage, and opening (electrically turning off) the other of the input and output contact portions at a fourth stage.

Control of on-off periods may be performed by geometrically shaping the terminals for temporal circuit of the protection plug and for temporal circuit of the fixed member differently.

Preferably, one and the other of a movable terminal for temporal circuit of the protection plug and a fixed terminal for temporal circuit of the fixed member forming the temporal circuit contact portion are provided with a first contact comprising a long protuberance being long substantially along a detachment direction of the protection plug and a second contact comprising a small protuberance.

The temporal circuit contact portion may be opened and/or closed by a fixed terminal for temporal circuit of the fixed member forming the temporal circuit contact portion and comprising a spring piece biased in a direction to be brought into contact with a movable terminal for temporal circuit of the protection plug. A second contact projects from the spring piece.

A movable terminal for temporal circuit of the temporal circuit contact portion in the protection plug may comprise a tab projecting towards the fixed member from a casing of the protection plug. A first contact projects from the tab and an insulating guide piece projects from the casing at the side of the tab.

The first and second contacts preferably are spaced apart although the insulating guide piece biases the spring piece toward the movable terminal for temporal circuit in the normal state where the protection plug is mounted to the fixed member. The first contact of the movable terminal for temporal circuit is moved for contact with the second contact and the fixed terminal for temporal circuit is returned substantially to its original shape by its spring force when the insulating guide piece is disengaged therefrom to separate the first and second contacts at the first stage during the detachment of the protection plug.

According to a further preferred embodiment, the movable terminal for temporal circuit and/or the fixed terminal for temporal circuit are made of an arc resistant material.

Tabs which will form the input and output contact portions preferably project toward the protection plug in the fixed circuit of the fixed member, the tab of the input contact portion projects farther than that of the output contact portion, recesses are formed in the mating end surfaces of projecting portions at the opposite sides of a casing of the protection plug, and female terminals connectable with the corresponding tabs are mounted in the recesses.

Preferably, the tabs and the female terminals at the input and output contact portions are still connected with each other at the first stage during the detachment of the protection plug. The female terminal of the output contact portion is separated from the corresponding tab at the second stage. The female terminal of the input contact portion is separated from the corresponding tab to open the input contact portion at the fourth stage after the temporal circuit contact portion is opened.

The method further may comprise the step of branching off a ground circuit from the temporal circuit contact portion between the terminal of the temporal circuit contact portion and the output contact portion in the fixed circuit of the fixed member.

The ground circuit may be branched off between the terminal of the temporal circuit contact portion and the tab of the output contact portion in the fixed circuit of the fixed member.

The ground circuit preferably has a ground circuit contact portion where a spring piece is resiliently brought into contact with a tab.

The ground circuit contact portion preferably is opened by an insulating bar projects from the protection plug in the normal state where the protection plug is inserted in or mounted to the fixed member by being insertable between the spring piece and the tab. The ground circuit contact portion is closed by the insulating bar thus allowing a connection of the load with the ground circuit by being disengageable from the ground circuit contact portion, after the input contact portion is opened at the fourth stage during the detachment of the protection plug.

Most preferably, the fixed member is fixed in an accommodating portion formed in a relay block, and an upstream end of the fixed circuit of the fixed member is connected with a high-voltage battery of 36V to 200V.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
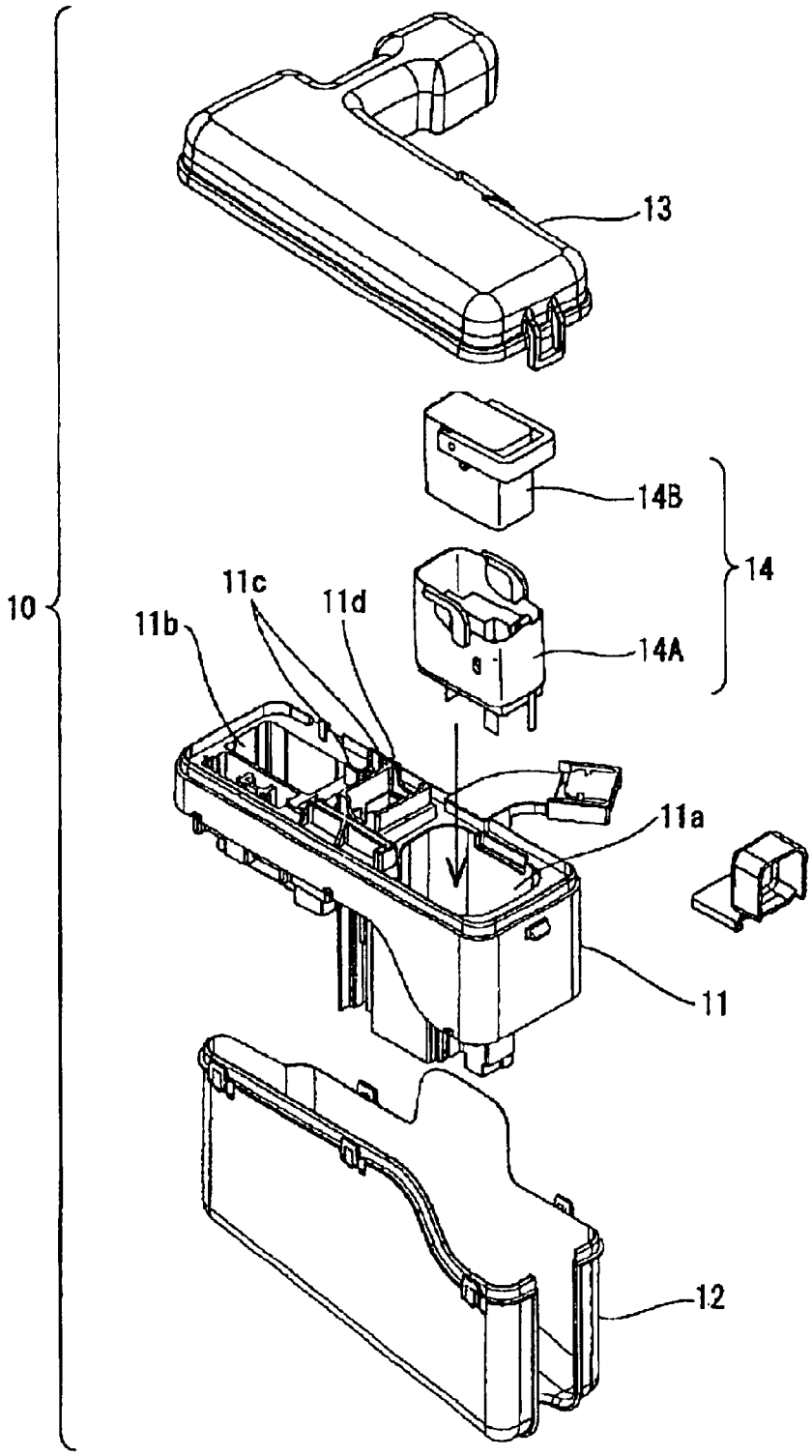
FIG. 1 is an exploded perspective view of a relay block according to one embodiment of the present invention.

FIG. 1 shows a relay block 10 constructed by covering a block main body 11 with a first cover 12 and a second cover 13. A fixed member 14A of a protecting device 14 for shutting off a power supply from a battery or other power source that has a high output voltage, such as about 36V to 200V, is fixedly accommodated in an accommodating portion 11*a* in one side of the block main body 11. A current sensor (not shown) is accommodated in an accommodating portion 11*b* at the other side; and a fusible-link accommodating portion 11*c* and a fuse accommodating portion 11*d* are provided in the middle.

A protection plug 14B is mounted into the fixed member 14A of the protecting device 14. The protection plug 14B breaks a power supply circuit by being detached from the fixed member 14A at the time of maintenance.

Figure 2:
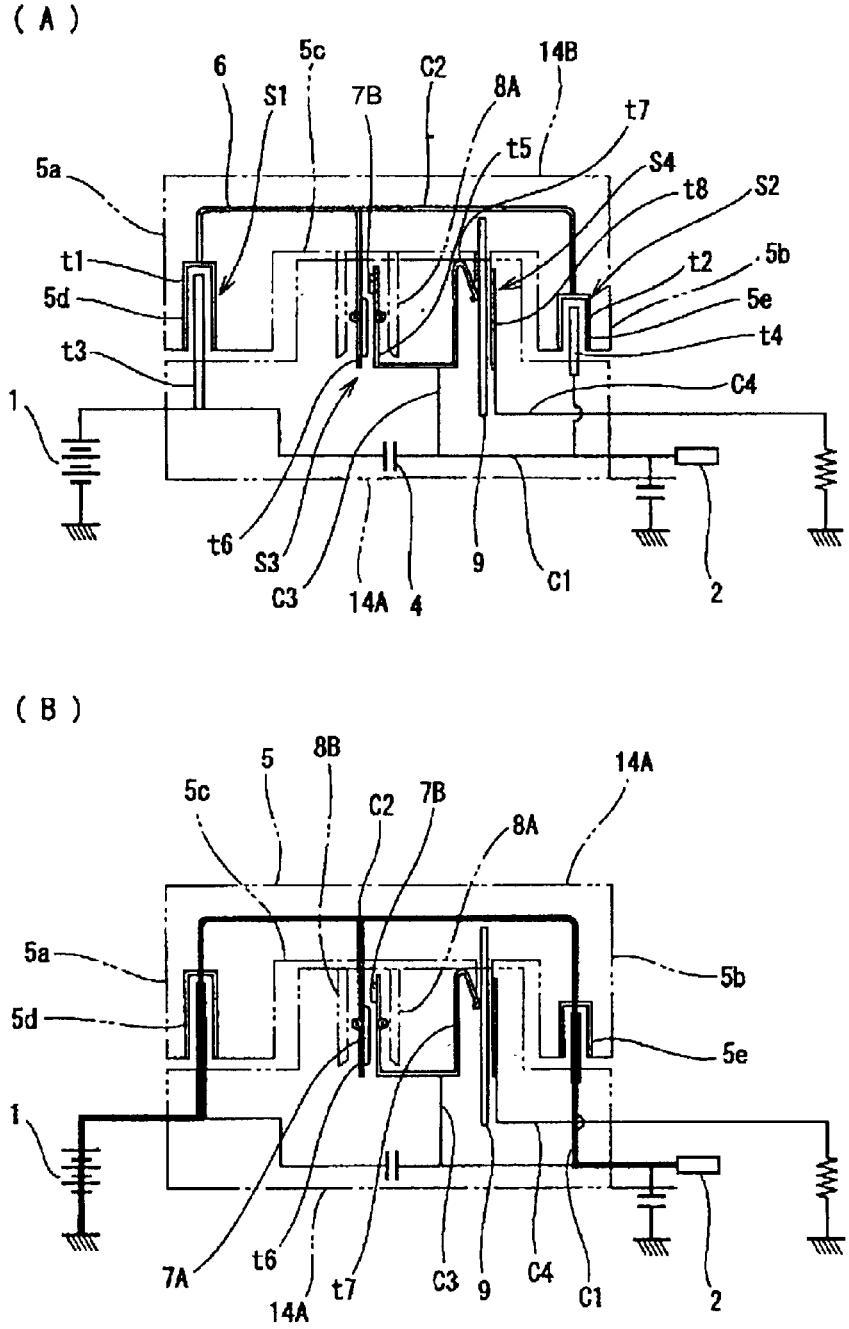
FIGS. 2A and 2B are a diagram showing a circuit construction in a normal state where a protection plug of the relay block is mounted and a diagram showing a current flow.

As shown in FIG. 2, the fixed member 14A to be fixed in the relay block 10 has a fixed circuit C1, whereas a movable circuit C2 for switching a power supply is in the protection plug 14B. The fixed circuit C1 and the movable circuit C2 are connected at the time of mounting the protection plug 14B. Thus, power is applied to a load 2 (inverter in this embodiment) connected at a downstream end from a power source 1, e.g. a high-voltage battery 1 of 42V connected at an upstream end of the fixed circuit C1.

A movable input terminal t1 and a movable output terminal t2 at the opposite ends of the movable circuit C2 of the protection plug 14B and a fixed input terminal t3 and a fixed output terminal t4 in the fixed circuit C1 of the fixed member 14A are connected and disconnected to form an input contact portion S1 and an output contact portion S2.

The fixed circuit C2 of the fixed member 14A is to be grounded after a downstream end of the fixed input terminal t3 is connected with a capacitor 4, and the fixed input terminal t3 and the fixed output terminal t4 are connected only via the circuit C2 of the protection plug 14B.

A temporal or temporary circuit C3 is branched off the fixed circuit C2 between the fixed output terminal t4 and the load 2, and a ground circuit C4 is branched off from the temporal circuit C3. The temporal circuit C3 becomes active (e.g. electrically conductive or switched on) only during, shortly before or shortly after the detachment operation of the protection plug 14B.

A fixed terminal t5 for temporal circuit C3 provided at the leading end of the temporal circuit C3 and a movable terminal t6 for temporal circuit C3 provided in the middle of the circuit C2 of the protection plug 14B are connected and disconnected to form a temporal circuit contact portion S3.

A ground circuit contact portion S4 for resiliently bringing a spring piece t7 into contact with a tab t8 is provided at an intermediate position of the ground circuit C4. The ground circuit contact portion S4 is opened (electrically turned off, interrupted or deactivated) by inserting an insulating bar 9 projecting from the protection plug 14B between the tab t8 and the spring piece t7.

A casing 5 of the protection plug 14B has downward-projecting portions 5*a*, 5*b* at opposite sides thereof and a center recess 5*c* between the projecting portions 5*a*, 5*b*. The bottom end surfaces of the downward-projecting portions 5*a*, 5*b* at the opposite sides are at the same height and recesses 5*d*, 5*e* are formed in the bottom surfaces of the downward-projecting portions 5*a*, 5*b*. The movable input terminal t1 is a female terminal fitted and fixed in the recess 5*d*, whereas the movable output terminal t2 is a female terminal fitted and fixed in the recess 5*e*. The recess 5*d* for the input terminal is deeper than the recess 5*e* for the output terminal. Thus, the height of the recess 5*d* is greater than that of the recess 5*e* along a connection/separating direction of the protection plug 14B and the fixed member 14A.

An electrically conductive plate 6 is built in the casing 5 and one end thereof is connected with the movable input terminal t1 and the other end thereof is connected with the movable output terminal t2.

During the mounting of the protection plug 14B, the movable input and output terminals t1, t2 in the recesses 5*d*, 5*e* engage and contact the tab-shaped fixed input and output terminals t3, t4 in the circuit C1 of the fixed member 14A, so that the contact portions S1, S2 are closed.

The fixed input terminal t3 is located higher than the fixed output terminal t4. Thus, at the time of detaching the protection plug 14B upward, after the movable output terminal t2 and the fixed output terminal t4 at the output contact portion S2 are disconnected, the movable input terminal t1 and the fixed input terminal t3 at the input contact portion S1 are disconnected.

A tab which serves as the movable terminal t6 projects down from a substantially middle position of the electrically conductive plate 6 built in the casing 5 of the protection plug 14B through the bottom surface of the middle recess 5*c*. A first contact 7A in the form of a vertically long protuberance projects from one side surface of the terminal t6.

Two spaced-apart unitarily formed insulating guide pieces 8A, 8B project from the middle recess 5*c* of the casing 5 and on opposite sides of the terminal t6.

The fixed terminal t5 for temporal circuit C3, which forms the temporal circuit contact portion S3 by being connected with and disconnected from the movable terminal t6 for temporal circuit C3, is formed of a spring piece that projects up from the leading end of the temporal circuit C3 of the fixed member 14A, and a second contact 7B in the form of a small protuberance projects from the terminal t5.

The terminals t5, t6 for temporal circuit both preferably are made of an arc resistant material.

The fixed terminal t5 formed of the spring piece is biased in a direction to separate from the movable terminal t6. In a normal state where the protection plug 14B is mounted, the movable terminal t6 is brought in a direction to contact the movable terminal t6 against its spring force by the insulating guide piece 8A. However, in this state, the contact 7B of the fixed terminal t5 is spaced up from the contact 7A of the movable terminal t6, whereby the temporal circuit contact portion S3 is open.

On the other hand, when the protection plug 14B is pulled up to be detached, the first contact 7A of the movable terminal t6 for temporal circuit slideably contacts the second contact 7B of the fixed terminal t5 for temporal circuit C3, and turns on the temporal circuit contact portion S3.

The temporal circuit contact portion S3 is turned on for a period controlled by the vertical dimension of the first contact 7A measured along the withdrawal direction of the protection plug 14B. At the same time the first contact 7A is disengaged from the second contact 7B, the insulating guide piece 8A is disengaged from the fixed terminal t5 and the second contact 7B is returned to its original position by the spring force, thereby turning off or deactivating the temporal circuit contact portion S3.

The temporal circuit contact portion S3 is turned on temporarily for a specified period when the protection plug 14B is detached. This contact portion S3 is turned on at a first stage where the input contact portion S1 and the output contact portion S2 are still on, and is turned off at a third stage after a second stage during which the output contact portion S2 is turned off. At a following fourth stage, the input contact portion S1 is turned off.

Preferably, the insulating bar 9 for opening or deactivating the ground circuit contact portion S4 projects in the middle recess 5*c* of the casing 5 of the protection plug 14B at a position between the insulating guide piece 8A and the downward-projecting portion 5*b* at the output terminal side. The insulating bar 9 projects more downward than the downward-projecting portions 5*a*, 5*b* at the opposite sides of the casing 5. At a fifth stage after the fourth stage where the input contact portion S1 is opened (or electrically turned off), the insulating bar 9 is disengaged from the ground circuit contact portion S4 to close it.

In the protecting device thus constructed, the input contact portion S1 and the output contact portion S2 are turned on and power is supplied from the power source or battery 1 to the load 2 as indicated by bold line in FIG. 2(B) in the normal state where the protection plug 14B is mounted in the fixed member 14A, as shown in FIG. 2(A). At this time, the temporal circuit contact portion S3 for preventing the creation of an arc is opened and the ground circuit contact portion S4 of the ground circuit C4 is opened by the insulating bar 9.

At the time of the maintenance of the electrical equipment, the protection plug 14B is pulled up to be detached from the fixed member 14A in order to shut off the power supply.

Figure 3:
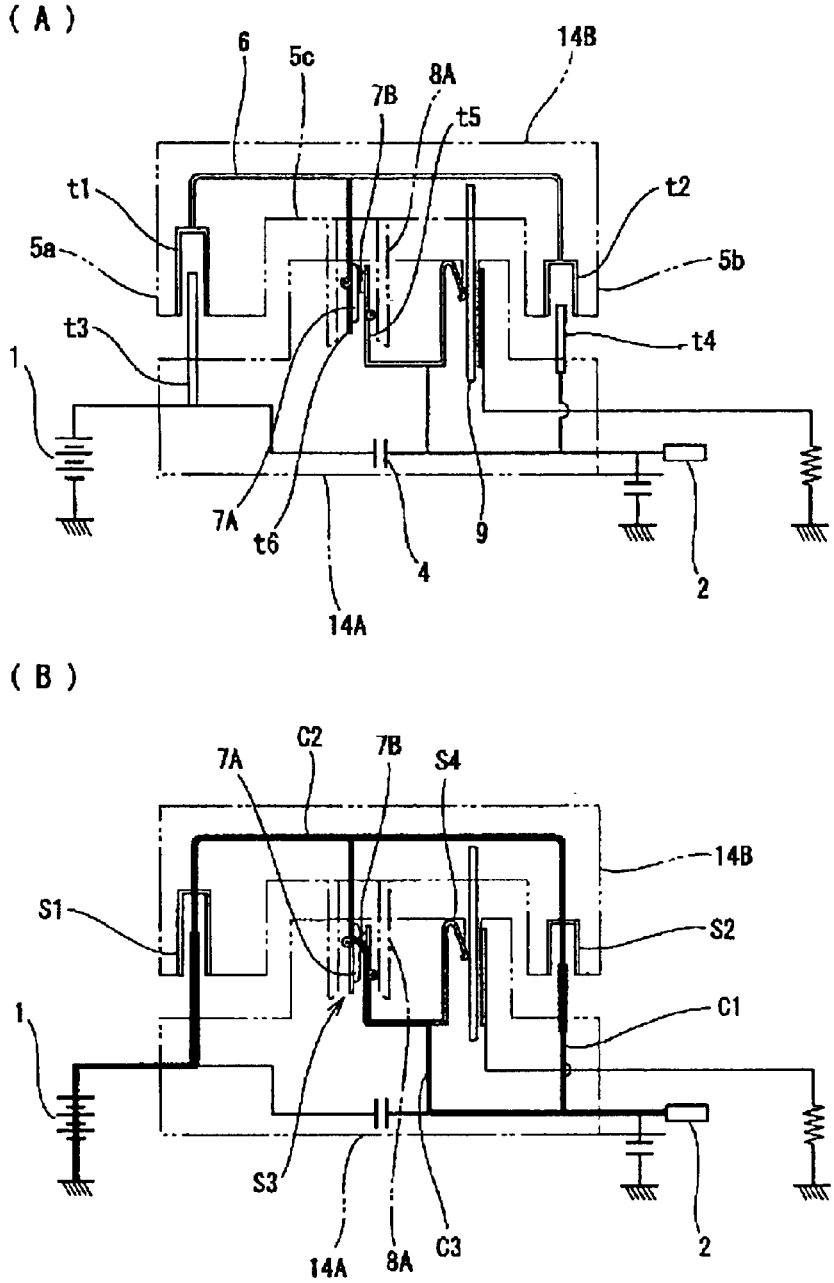
FIGS. 3A and 3B is a diagram showing a circuit construction at a first stage during the detachment of the protection plug and a diagram showing a current flow.

During this detachment, the temporal circuit contact portion S3 is turned on at the first stage with the input and output contact portions S1, S2 closed (or electrically turned on) (ON) as shown in FIG. 3. Thus, as indicated by bold line in FIG. 3(B), the power is applied from the battery 1 to the load part 2 via the output contact portion S2 and also via the temporal circuit contact portion S3 and the temporal circuit C3.

Figure 4:
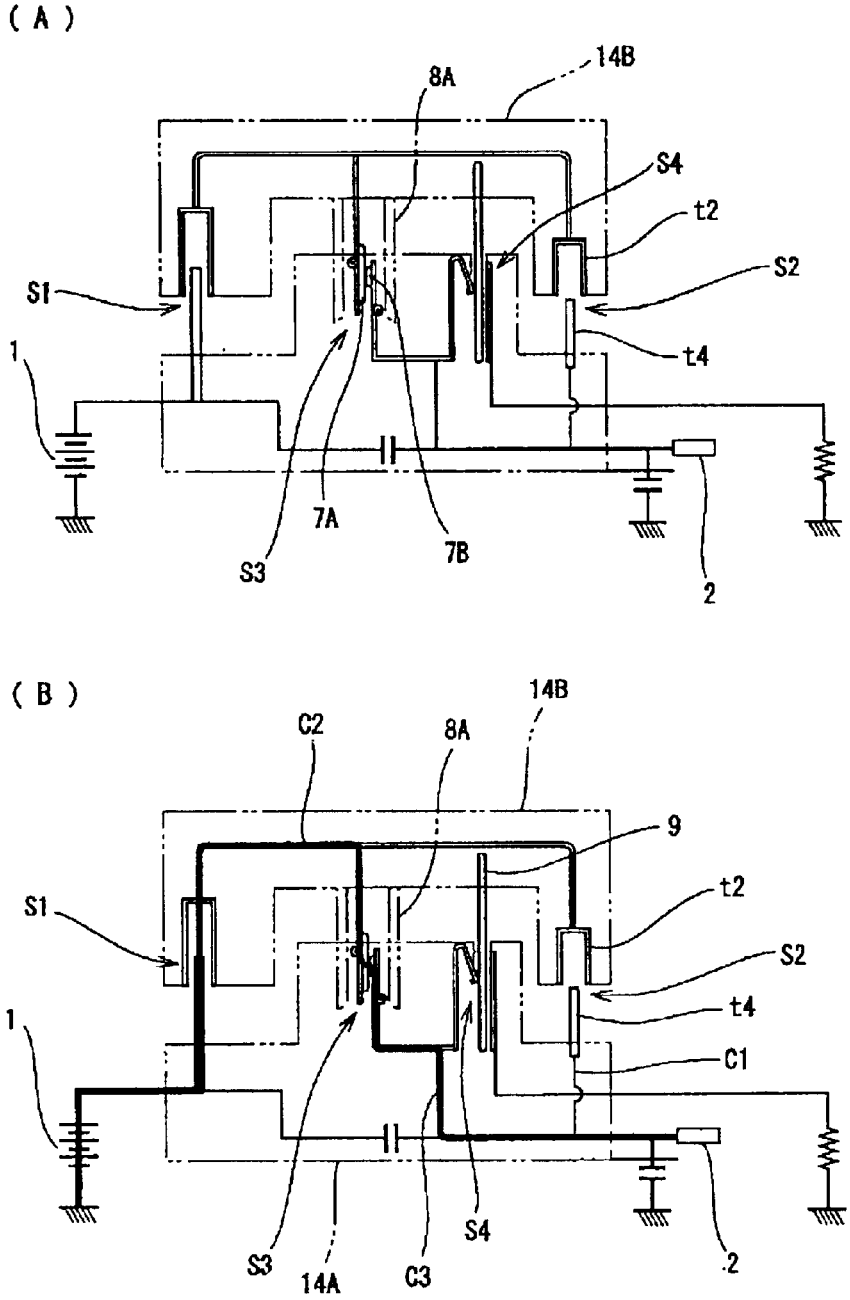
FIGS. 4A and 4B are a diagram showing a circuit construction at a second stage during the detachment of the protection plug and a diagram showing a current flow.

At the second stage, the movable output terminal t2 is first disengaged from the fixed output terminal t4 to turn the output contact portion S2 off as shown in FIG. 4. At this time, the load part 2 is connected with the battery 1 via the temporal circuit C3 and the temporal circuit contact portion S2 as indicated by bold line in FIG. 4(B). Thus, no arc is created between the terminals t2 and t4 when the terminals t2 and t4 at the output contact portion S2 are disconnected from each other.

Figure 5:
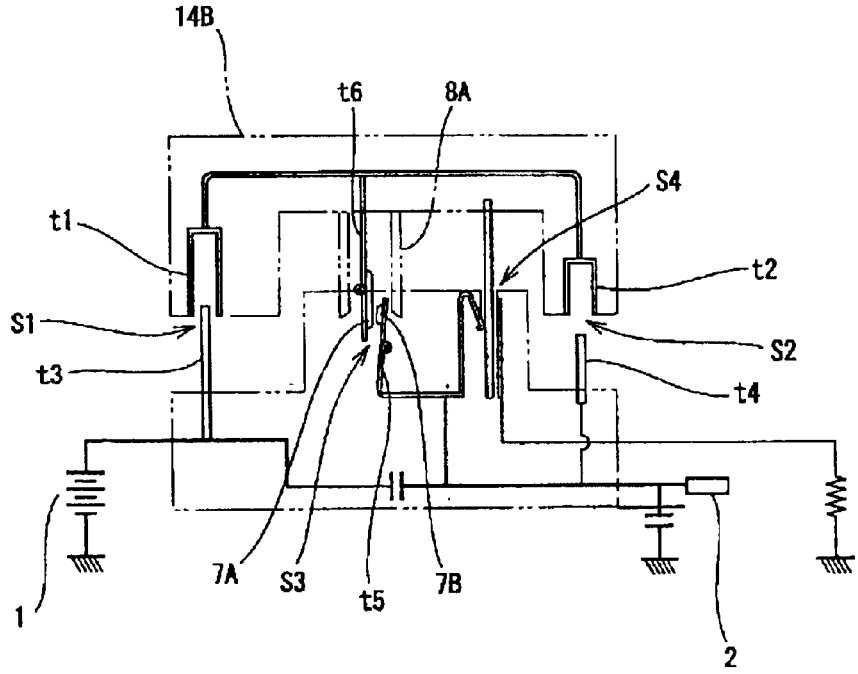
FIG. 5 is a diagram showing a circuit construction at a third stage during the detachment of the protection plug.
Figure 6:
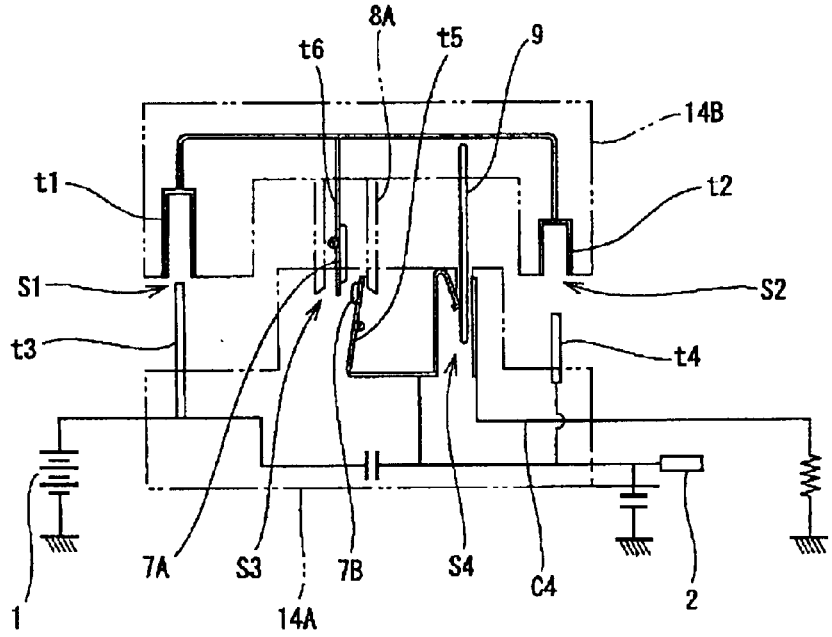
FIG. 6 is a diagram showing a circuit construction at a fourth stage during the detachment of the protection plug

Since the insulating guide piece 8A is disengaged from the fixed terminal t5 for temporal circuit, which preferably is a spring piece, at the third stage as shown in FIG. 5, the terminal t5 is disengaged from the movable terminal t6 for temporal circuit C3 by its spring force to open the temporal circuit contact portion S3. At this time, there is a possibility of creating an arc between the movable terminal t6 for temporal circuit and the terminal t5. However, these terminals t6, t5 are made of the arc resistant material and are normally disconnected during the power supply. Thus, even if these terminals t5, t6 are damaged, it does not cause a big problem as compared to a case where the terminals t1–t4 at the input and output contact portions S1, S2, which are normally connected during the power supply, are damaged Since the output contact portion S2 and the temporal circuit contact portion S3 are both off at the third stage, the power supply circuit connecting the battery 1 and the load part 2 is broken. Thus, when the movable input terminal t1 of the input contact portion S1 is disengaged from the fixed input terminal t3 to turn the input contact portion S1 off at the fourth stage as shown in FIG. 6, there is no danger of creating an arc between the terminals t1 and t3.

Figure 7:
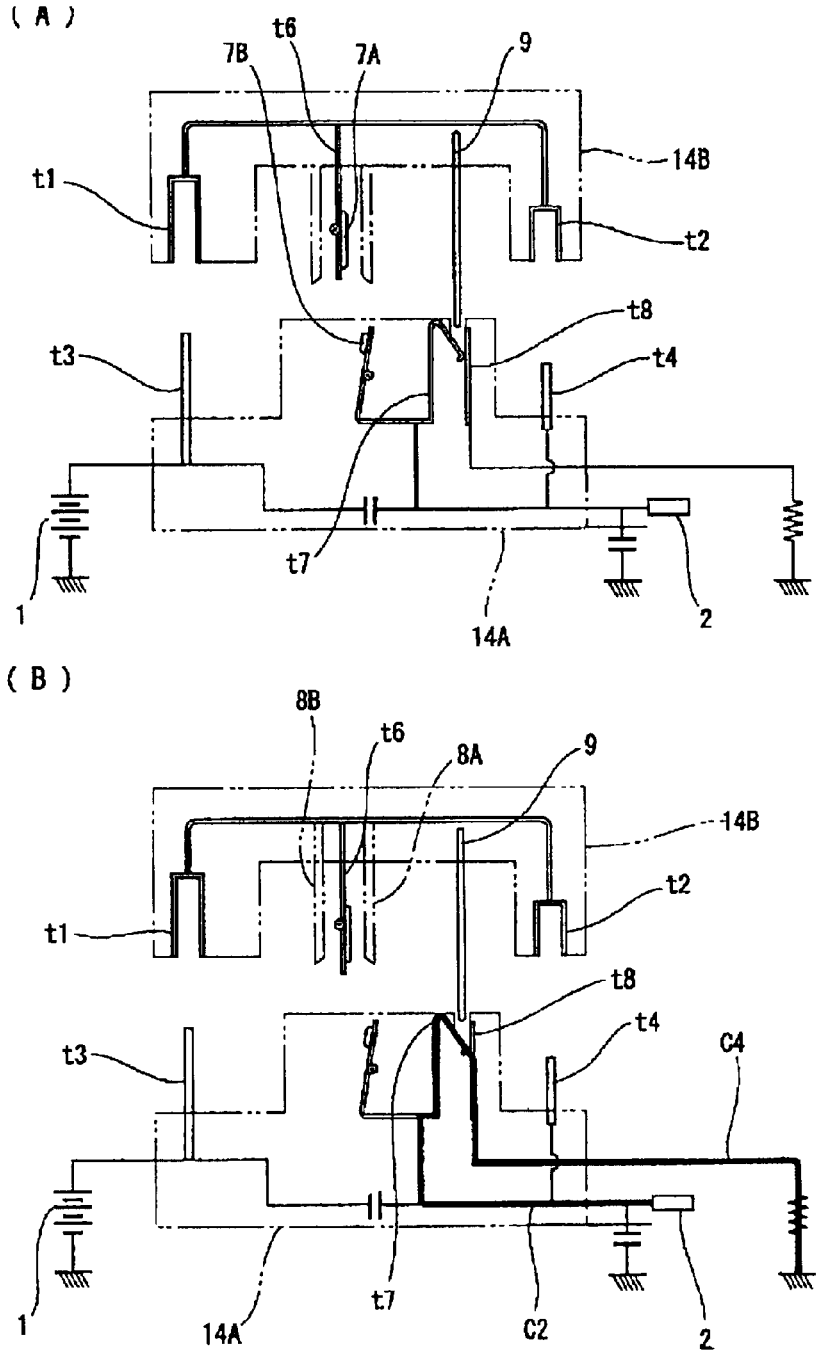
FIGS. 7A and 7B are a diagram showing a circuit construction at a fifth stage during the detachment of the protection plug and a diagram showing a current flow.

At the fifth stage where the protection plug 14B is pulled up as shown in FIG. 7, the insulating bar 9 disengages from the ground circuit contact portion S4 to bringing the terminals t7, t8 into contact to close the ground circuit contact portion S4.

Thus, as indicated by bold line in FIG. 7(B), the ground circuit C4 is electrically connected with a load circuit in the load part 2 via the temporal circuit C3, thereby grounding electric charges still residual in the load circuit.

The present invention is not limited to the above preferred embodiment. An order of turning off the contact portions at the time of detaching the protection plug may be (input contact portion)→(temporal circuit contact portion)→(output contact portion). In such a case, the temporal circuit is branched off from a circuit of the fixed member at the input side of the power supply, so that the power supply side circuit, the temporal circuit contact portion, the output contact portion and the load side circuit are connected, i.e. the power supply side and the load side are connected, even if the input contact portion is turned off at the second stage.

Instead of forming the fixed terminal for temporal circuit at the temporal circuit contact portion of the spring piece, the on-off periods of the temporal circuit contact portion may be set by adjusting the length of the contact of the movable terminal for temporal circuit.

The on-period at the temporal circuit contact portion may be controlled by forming the first contact of the movable terminal as a small protuberance and the second contact of the fixed terminal as a vertically long protuberance.

As described above, the temporal circuit contact portion, which is normally open, is closed in the process of detaching the protection plug to break the power supply circuit for maintenance. Thus, no arc is created between the terminals at the output contact portion which is turned off earlier, and the power supply is shut off by turning off the temporal circuit contact portion before the input contact portion is turned off. Therefore, no arc is created between the terminals at the input contact portion.

No arc is created between the terminals at the input and output contact portions electrically connecting the power supply circuit. Thus damage of the terminals can be prevented.

In the case of using the high-voltage battery of 36V to 200V, an arc is likely to be created when the input and output terminals are disconnected. The creation of such an arc between the input and output terminals can be prevented by adopting the above preferred construction, and the above protecting device can be used with the high-voltage battery.

One and the other of the terminals to be brought into contact with each other at the temporal circuit contact portion have a contact in the form of a small protuberance and a contact in the form of a vertically long protuberance. The vertically long protuberance is slid into contact with the small protuberance. Thus, the on-off periods of the temporal circuit contact portion can be controlled by adjusting the length of the vertically long protuberance and/or the position of the terminals of the temporal circuit contact portion.

Further, since it is sufficient to provide three contact portions: the input contact portion, the output contact portion and the temporal circuit contact portion between the circuit of the protection plug and the circuit fixed in the electrical connection box, the construction can be simplified.

Further, even in the case of providing the ground circuit for grounding the electric charges residual in the load-side circuit at the time of shutting the power supply off, the ground circuit contact portion provided in the circuit fixed in the electrical connection box can be opened (or electrically turned off or deactivated) and closed (or electrically turned on or activated) by causing the insulating bar provided in the protection plug to project and retract, and no terminal is necessary in the protection plug. Thus, the construction can be simplified.

What is claimed is:

1. A protecting device in which a protection plug for switching a power supply circuit is detachably mountable to a fixed member to connect a movable circuit in the protection plug and a fixed circuit of the fixed member and form a power supply circuit for supplying a power to a load, and the power supply circuit is broken by detaching the protection plug, wherein:

an input contact portion, a temporal circuit contact portion and an output contact portion are provided between a terminal in the movable circuit of the protection plug and a terminal in the fixed circuit of the fixed member, the input contact portion and the output contact portion are closed to supply the power to the load and the temporal circuit contact portion is opened in a normal state where the protection plug is mounted to the fixed member, and the temporal circuit contact portion is closed and connected with the power supply circuit at a first stage during the detachment of the protection plug, and with the input contact portion and the output contact portions being closed at the first stage during the detachment of the protection plug, a first of the input contact portion and the output contact portions is opened at a second stage of the detachment of the protection plug, the temporal circuit contact portion is opened at a third stage of the detachment of the protection plug, and a second of the input contact portion and the output contact portions is opened at a fourth stage of the detachment of the protection plug.

2. The protecting device of claim 1, wherein:

one and the other of a movable terminal for temporal circuit of the protection plug and a fixed terminal for temporal circuit of the fixed member forming the temporal circuit contact portion are provided with a first contact comprising a long protuberance that is long substantially along a detachment direction of the protection plug and a second contact comprising a small protuberance.

3. The protecting device of claim 2, wherein the first and second contacts are separated in the normal state where the protection plug is mounted in or to the fixed member while being brought into sliding contact with each other during the detachment of the protection plug, enabling a control of on-off periods.

4. The protecting device of claim 1, wherein:

a fixed terminal for temporal circuit of the fixed member forming the temporal circuit contact portion comprises a spring piece biased in a direction to be brought into contact with a movable terminal for temporal circuit of the protection plug and a second contact projects from the spring piece.

5. The protecting device of claim 4, wherein a movable terminal for temporal circuit of the temporal circuit contact portion provided in the protection plug comprises a tab projecting towards the fixed member from a casing of the protection plug, a first contact projects from the tab and an insulating guide piece projects from the casing at a side of the tab.

6. The protecting device of claim 5, wherein the first and second contacts are spaced apart and the insulating guide piece biases the spring piece toward the movable terminal for temporal circuit in the normal state where the protection plug is mounted to the fixed member, the first contact of the movable terminal for temporal circuit is moved for contact with the second contact and the fixed terminal for temporal circuit is returned substantially to its original shape by its spring force when the insulating guide piece is disengaged therefrom to separate the first and second contacts at the first stage during the detachment of the protection plug.

7. The protecting device of claim 6, wherein the movable terminal for temporal circuit and the fixed terminal for temporal circuit are made of an arc resistant material.

8. The protecting device of claim 1, wherein:

tabs form the input and output contact portions and project toward the protection plug in the fixed circuit of the fixed member, the tab of the input contact portion projects a longer distance than the tab of the output contact portion, recesses are formed in the mating side end surfaces of projecting portions at the opposite sides of a casing of the protection plug, and female terminals connectable with the corresponding tabs are mounted in the recesses.

9. The protecting device of claim 8, wherein the tabs and the female terminals at the input and output contact portions are still connected with each other at the first stage during the detachment of the protection plug, the female terminal of the output contact portion is separated from the corresponding tab at the second stage, and the female terminal of the input contact portion is separated from the corresponding tab to open the input contact portion at the fourth stage after the temporal circuit contact portion is opened.

10. The protecting device of claim 1, wherein a ground circuit is branched off from the temporal circuit contact portion between the terminal of the temporal circuit contact portion and the output contact portion in the fixed circuit of the fixed member.

11. The protecting device of claim 10, wherein the ground circuit is branched off between the terminal of the temporal circuit contact portion and the tab of the output contact portion in the fixed circuit of the fixed member.

12. The protecting device of claim 11, wherein the ground circuit is provided with a ground circuit contact portion where a spring piece is resiliently brought into contact with a tab.

13. The protecting device of claim 12, wherein an insulating bar projects from the protection plug, and the insulating bar can open the ground circuit contact portion in the normal state where the protection plug is mounted to the fixed member by being insertable between the spring piece and the tab, and the insulating bar can close the ground circuit contact portion and allow a connection of the load with the ground circuit by being disengageable from the ground circuit contact portion, after the input contact portion is opened at the fourth stage during the detachment of the protection plug.

14. The protecting device of claim 1, wherein the fixed member is fixed in an accommodating portion formed in a relay block, and an upstream end of the fixed circuit of the fixed member is connectable with a high-voltage battery of 36V to 200V.

15. A method of shutting off a power supply by means of a protecting device in which a protection plug for switching a power supply circuit is detachably mountable to a fixed member to connect a movable circuit in the protection plug and a fixed circuit of the fixed member and form a power supply circuit for supplying a power from the power supply to a load, and the power supply circuit is broken by detaching the protection plug, comprising the steps of:

providing an input contact portion, a temporal circuit contact portion and an output contact portion between a terminal provided in the movable circuit of the protection plug and a terminal provided in the fixed circuit of the fixed member, closing the input contact portion and the output contact portion to supply the power to the load and opening the temporal circuit contact portion in a normal state where the protection plug is mounted to the fixed member, closing the temporal circuit contact portion and connecting it with the power supply circuit with the input contact portion and the output contact portions closed at a first stage during detachment of the protection plug, opening a first of the input contact portion and the output contact portions at a second stage during detachment of the protection plug, opening the temporal circuit contact portion at a third stage of the detachment of the protection plug, and opening a second of the input contact portion and the output contact portion at a fourth stage of detachment of the protection plug.

16. The method of claim 15, wherein a control of on-off periods is preferably by geometrically shaping the terminals for temporal circuit of the protection plug and for temporal circuit of the fixed member differently.

17. The method of claim 16, wherein the temporal circuit contact portion is opened and closed by means of a fixed terminal for temporal circuit of the fixed member forming the temporal circuit contact portion and comprising a spring piece biased in a direction for contact with a movable terminal for temporal circuit of the protection plug, wherein a second contact projects from the spring piece.

18. The method of claim 17, wherein tabs form the input and output contact portions and project toward the protection plug in the fixed circuit of the fixed member, the tabs and female terminals at the input and output contact portions are still connected with each other at the first stage during the detachment of the protection plug, the female terminal of the output contact portion is separated from the corresponding tab at the second stage, and the female terminal of the input contact portion is separated from the corresponding tab to open the input contact portion at the fourth stage after the temporal circuit contact portion is opened.

19. The method of claim 15, further comprising the step of:

branching off a ground circuit from the temporal circuit contact portion between the terminal of the temporal circuit contact portion and the output contact portion in the fixed circuit of the fixed member.

20. The method of claim 19, further comprising providing a ground circuit contact portion in the ground circuit, and opening the ground circuit contact portion by an insulating bar projecting from the protection plug in the normal state where the protection plug is mounted to the fixed member by being insertable between the spring piece and the tab, and closing the ground circuit contact portion by the insulating bar thus allowing a connection of the load with the ground circuit by being disengageable from the ground circuit contact portion, after the input contact portion is opened at the fourth stage during the detachment of the protection plug.

* * * * *